US011607012B2

(12) United States Patent
Cheney

(10) Patent No.: US 11,607,012 B2
(45) Date of Patent: Mar. 21, 2023

(54) RAPID-ENTRY FOOTWEAR HAVING A ROTATING TONGUE

(71) Applicant: FAST IP, LLC, Lindon, UT (US)

(72) Inventor: Craig Cheney, Lindon, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 17/871,794

(22) Filed: Jul. 22, 2022

(65) Prior Publication Data

US 2022/0354220 A1 Nov. 10, 2022

Related U.S. Application Data

(63) Continuation of application No. PCT/US2022/021821, filed on Mar. 24, 2022.

(60) Provisional application No. 63/165,427, filed on Mar. 24, 2021.

(51) Int. Cl.

| | |
|---|---|
| ***A43B 23/26*** | (2006.01) |
| ***A43C 11/00*** | (2006.01) |
| ***A43B 11/00*** | (2006.01) |

(52) U.S. Cl.

CPC ..... *A43B 23/26* (2013.01); *A43B 11/00* (2013.01); *A43C 11/008* (2013.01)

(58) Field of Classification Search

None

See application file for complete search history.

(56) References Cited

U.S. PATENT DOCUMENTS

| | | | |
|---|---|---|---|
| 112,439 | A | 3/1871 | Francis |
| 808,948 | A | 1/1906 | Roberts et al. |
| 827,330 | A | 7/1906 | Tillson |
| 863,549 | A | 8/1907 | Metz |
| 881,153 | A | 3/1908 | Rickert |
| 923,860 | A | 6/1909 | Kroell |
| 921,461 | A | 9/1909 | Rickert |
| 1,081,678 | A | 12/1913 | Langerak |
| 1,116,462 | A | 11/1914 | Moran |
| 1,464,342 | A | 8/1923 | Rothacher |
| 1,494,236 | A | 5/1924 | Greathouse |
| 1,686,175 | A | 10/1928 | Read |
| 1,926,818 | A | 9/1933 | Ratcliff |
| 2,069,752 | A | 8/1935 | Dorr |
| 2,266,732 | A | 4/1940 | Babinchak |
| 2,368,514 | A | 1/1945 | Baehr |
| 2,450,250 | A | 3/1945 | Napton |
| 2,452,502 | A | 4/1945 | Tarbox |
| 2,736,110 | A | 2/1956 | Hardimon |

(Continued)

FOREIGN PATENT DOCUMENTS

| | | |
|---|---|---|
| CN | 2438353 | 7/2001 |
| CN | 1403041 | 3/2003 |

(Continued)

OTHER PUBLICATIONS

International Search Report and Written Opinion dated Jul. 12, 2022 in PCT International Patent Application No. PCT/US2022/21821.

(Continued)

*Primary Examiner* — Jila M Mohandesi

(57) ABSTRACT

A rapid-entry shoe with a rotating tongue having an open configuration for ease of donning or doffing by a foot and also having a closed configuration for retention of the foot.

7 Claims, 4 Drawing Sheets

(56) References Cited

U.S. PATENT DOCUMENTS

| | | | | |
|---|---|---|---|---|
| 2,763,071 | A | 9/1956 | Kingsley | |
| 2,829,448 | A | 4/1958 | Minera | |
| 2,920,402 | A | 1/1960 | Minera | |
| 3,000,116 | A | 9/1961 | Ally | |
| 3,146,535 | A | 9/1964 | Owings | |
| 4,489,509 | A | 12/1984 | Libit | |
| 4,590,690 | A | 5/1986 | Pfander | |
| 4,811,502 | A | 3/1989 | Barret | |
| 4,924,605 | A | 5/1990 | Spademan | |
| 4,972,613 | A | 11/1990 | Loveder | |
| 5,054,216 | A | 10/1991 | Lin | |
| 5,127,170 | A | 7/1992 | Messina | |
| 5,181,331 | A | 1/1993 | Berger | |
| 5,184,410 | A | 2/1993 | Hamilton | |
| 5,282,327 | A | 2/1994 | Ogle | |
| 5,341,583 | A | 8/1994 | Hallenbeck | |
| 5,371,957 | A | 12/1994 | Gaudio | |
| 5,467,537 | A | 11/1995 | Aveni et al. | |
| 5,481,814 | A | 1/1996 | Spencer | |
| 5,842,292 | A | 12/1998 | Siesel | |
| 5,997,027 | A | 12/1999 | Jungkind | |
| 6,000,148 | A | 12/1999 | Cretinon | |
| 6,125,555 | A | 10/2000 | Schenkel | |
| 6,189,239 | B1 | 2/2001 | Gasparovic et al. | |
| 6,360,454 | B1 | 3/2002 | Dachgruber | |
| 6,378,230 | B1 | 4/2002 | Rotem et al. | |
| 6,671,980 | B1 | 1/2004 | Liu | |
| 6,684,533 | B1 | 2/2004 | Su | |
| 6,922,917 | B2 | 8/2005 | Kerns | |
| 6,925,732 | B1 | 8/2005 | Clarke | |
| 6,938,361 | B2 | 9/2005 | Su | |
| 7,103,994 | B2 | 9/2006 | Johnson | |
| 7,178,270 | B2 | 2/2007 | Hurd et al. | |
| 7,225,563 | B2 | 6/2007 | Chen | |
| 7,439,837 | B2 | 10/2008 | McDonald | |
| 7,661,205 | B2 | 2/2010 | Johnson | |
| 7,685,747 | B1 | 3/2010 | Gasparovic et al. | |
| 7,793,438 | B1 | 9/2010 | Busse et al. | |
| 7,823,299 | B1 | 11/2010 | Brigham | |
| 7,975,403 | B2 * | 7/2011 | Mosher | A43B 23/26 36/51 |
| D648,512 | S | 11/2011 | Schlageter | |
| 8,065,819 | B2 | 11/2011 | Kaufman | |
| 8,087,188 | B2 * | 1/2012 | Labbe | A43C 11/008 24/712 |
| 8,161,669 | B2 | 4/2012 | Keating | |
| 8,225,535 | B2 | 7/2012 | Dillenbeck | |
| 8,499,474 | B2 | 8/2013 | Kaufman | |
| 8,769,845 | B2 | 7/2014 | Lin | |
| 9,615,624 | B2 | 4/2017 | Kilgore et al. | |
| 9,675,132 | B2 | 6/2017 | Marshall | |
| 9,820,527 | B2 | 11/2017 | Pratt et al. | |
| 9,877,542 | B2 | 1/2018 | Pratt | |
| 9,999,278 | B2 * | 6/2018 | Feinstein | A43C 11/165 |
| 10,306,947 | B2 | 6/2019 | Pratt et al. | |
| 10,455,898 | B1 | 10/2019 | Orand et al. | |
| 2002/0144434 | A1 | 10/2002 | Farys | |
| 2005/0022428 | A1 | 2/2005 | Anderson | |
| 2005/0039348 | A1 | 2/2005 | Raluy et al. | |
| 2005/0076540 | A1 | 4/2005 | Su | |
| 2005/0198867 | A1 | 9/2005 | Labbe | |
| 2007/0074425 | A1 | 4/2007 | Leong | |
| 2008/0086911 | A1 * | 4/2008 | Labbe | A43C 11/008 36/50.1 |
| 2008/0189984 | A1 | 8/2008 | Januszewski et al. | |
| 2008/0307673 | A1 | 12/2008 | Johnson | |
| 2009/0090026 | A1 | 4/2009 | Mosher | |
| 2011/0016751 | A1 | 1/2011 | Somerville | |
| 2011/0146106 | A1 | 6/2011 | Kaufman | |
| 2012/0216429 | A1 | 8/2012 | Bastida et al. | |
| 2012/0317839 | A1 | 12/2012 | Pratt | |
| 2013/0185959 | A1 | 7/2013 | Coleman | |
| 2013/0219747 | A1 | 8/2013 | Lederer | |
| 2015/0305432 | A1 | 10/2015 | Wiens | |
| 2016/0374427 | A1 | 12/2016 | Zahabian | |
| 2017/0303632 | A1 | 10/2017 | Pratt | |
| 2017/0360143 | A1 | 12/2017 | Pratt | |
| 2017/0360151 | A1 | 12/2017 | Pratt | |
| 2018/0110287 | A1 | 4/2018 | Hopkins et al. | |
| 2018/0110292 | A1 | 4/2018 | Beers et al. | |
| 2018/0289109 | A1 | 10/2018 | Beers et al. | |
| 2018/0295942 | A1 | 10/2018 | Drake | |

FOREIGN PATENT DOCUMENTS

| | | |
|---|---|---|
| CN | 201005111 | 1/2008 |
| DE | 19534249 | 3/1997 |
| DE | 19611797 | 10/1997 |
| DE | 29809404 | 8/1998 |
| DE | 10247163 | 10/2002 |
| DE | 102004005288 | 8/2005 |
| EP | 1059044 | 12/2000 |
| EP | 3266327 | 1/2018 |
| FR | 3066679 | 11/2018 |
| GB | 2517399 | 8/2013 |
| JP | 181910 | 6/1989 |
| JP | 2001149394 | 6/2001 |
| JP | 2006055571 | 3/2006 |
| WO | 2007080205 | 7/2007 |
| WO | 2009089572 | 7/2009 |
| WO | 2009154350 | 12/2009 |
| WO | 2017004135 | 1/2017 |

OTHER PUBLICATIONS

U.S. Appl. No. 62/186,148, filed Jun. 29, 2015, Zahabian.

Sneider, "Kizik Handsfree New York Shoe Review," https://the-gadgeteer.com/2018/06/27/kizik-handsfree-new-york-show-review/ (2018).

https://www.teva.com/kids-sandals/hurricane-drift/ 1102483C.html submitted herewith as of Jun. 13, 2019.

https://us.ecco.com/ecco-biom-fjuel-mens-outdoor-shoe-837594.html?dwvar_837594_color=00001 submitted herewith as of Jun. 1, 2016.

* cited by examiner

RAPID-ENTRY FOOTWEAR HAVING A ROTATING TONGUE

CROSS-REFERENCE TO RELATED APPLICATIONS

This application is a continuation of, claims priority to and the benefit of PCT Serial No. PCT/US22/21821 filed Mar. 24, 2022 and entitled "RAPID-ENTRY FOOTWEAR HAVING A ROTATING TONGUE." PCT Serial No. PCT/US22/21821 claims the benefit of U.S. Provisional Patent Application No. 63/165,427, filed Mar. 24, 2021 and entitled "RAPID-ENTRY FOOTWEAR HAVING A ROTATING TONGUE." All of the aforementioned applications are incorporated herein by reference in their entireties.

FIELD

The present disclosure relates to footwear, and more particularly to rapid-entry footwear having a rotating tongue.

BACKGROUND

Whether due to inconvenience or inability, donning and doffing of shoes, including tying or otherwise securing the same, may be undesirable and/or present difficulties to some individuals. The present disclosure addresses this need.

SUMMARY

A rapid-entry shoe of the present disclosure comprises a sole portion, an upper coupled to the sole portion, an inner surface of the upper defining a volume for receiving a foot of a user, and a rotating tongue. In example embodiments, the rotating tongue is coupled to the upper at a medial hub point and a lateral hub point is aligned along a hub axis extending through the upper. In example embodiments, the rotating tongue comprises a tongue forward portion positioned forward the hub axis and a tongue rear portion positioned rearward the hub axis.

In example embodiments, the rotating tongue has an open configuration and a closed configuration. In example embodiments, the rotating tongue is stable in the open configuration and in the closed configuration. In example embodiments, in the open configuration, the tongue forward portion is rotated downward toward the sole portion about the hub axis to at least partially bisect the volume, and the tongue rear portion is rotated upward away from the sole portion about the hub axis to expand an opening to the volume to facilitate easy entry of the foot. In example embodiments, in the closed configuration, the tongue forward portion is rotated upward away from the sole portion about the hub axis by the foot entering the opening to the volume to no longer at least partially bisect the volume, and the tongue rear portion is rotated downward toward the sole portion about the hub axis to narrow the opening to the volume to facilitate securement of the foot.

In example embodiments, shoe further comprises an elongated element having a first end coupled to the rotating tongue at a coupling point and a second end coupled to the sole portion or the upper, wherein the first end is not coupled to the upper. In example embodiments, the elongated element does not intersect with the hub axis in either the open configuration or the closed configuration.

In example embodiments, the elongated element and is longer in the open configuration than in the closed configuration (or about the same length in the open configuration and the closed configuration), and the hub axis is forward relative to the coupling point in the closed configuration and rearward relative to the coupling point in the open configuration. In example embodiments, the elongated element is shorter in the open configuration than in the closed configuration, and the hub axis is rearward relative to the coupling point in the closed configuration and forward relative to the coupling point in the open configuration.

In example embodiments, the elongated element comprises a plurality of positive features to selectively engage with one or more of a plurality of corresponding negative features coupled to the upper to selectively lock the rotating tongue in the open configuration or the closed configuration.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
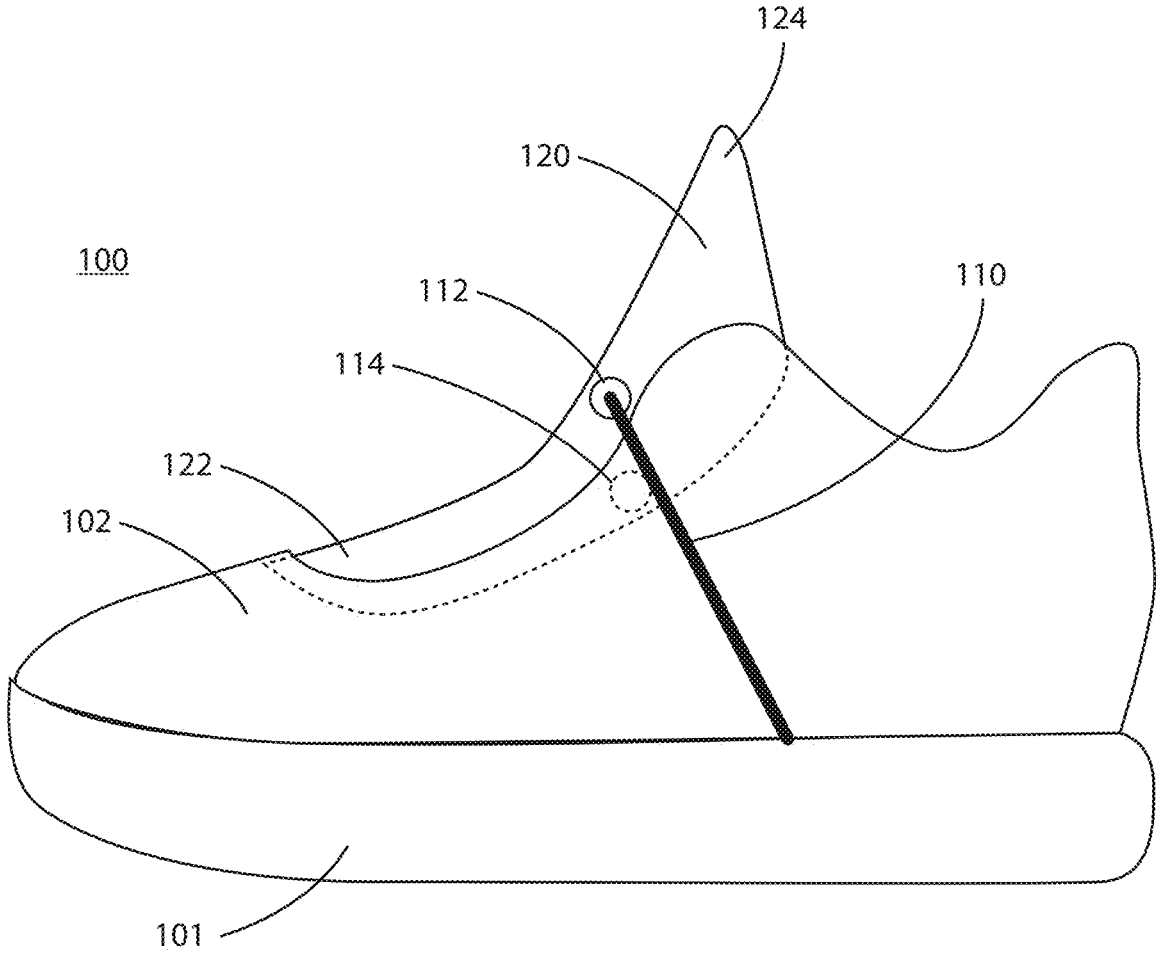
FIG. 1A illustrates a rapid-entry shoe in accordance with the present disclosure.

Example embodiments of the present disclosure are described in sufficient detail in this detailed description to enable persons having ordinary skill in the relevant art to practice the present disclosure, however, it should be understood that other embodiments may be realized and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, nonintegral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, unless the context dictates otherwise, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

As used herein, unless the context dictates otherwise, a "sole portion" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe, for example, an insole or an internal cushion.

With reference to FIG. 1A, in accordance with example embodiments, a rapid-entry shoe 100 of the present disclosure comprises a sole portion 101 and an upper 102 coupled to the sole portion 101, an inner surface of the upper 102 defining a volume for receiving a foot of a user.

In accordance with example embodiments of the present disclosure, a rapid-entry shoe 100 further comprises a rotating tongue 120. In example embodiments, the rotating tongue 120 can be coupled to the upper 102 at a medial hub point 114 and/or a lateral hub point 114 (each of the medial hub point 114 and the lateral hub point 114 being similarly situated on opposing sides of rapid-entry shoe 100) aligned along a hub axis extending through the upper 102. Stated another way, a hub axis can be drawn through the medial hub point 114 and the lateral hub point 114. In some embodiments, the hub axis is approximately parallel to the sole portion 101 (e.g., a top surface of the sole portion 101). In example embodiments, a hub point 114 permits rotating or pivoting movement between a rotating tongue 120 and the upper 102 of a rapid-entry shoe 100. In example embodiments, a hub point 114 comprises a flexible stich, a rotating grommet/eyelet, a button or the like, the foregoing coupling rotating tongue 120 to the upper 102 of a rapid-entry shoe 100.

In example embodiments, the rotating tongue 120 comprises a tongue forward portion 122 positioned forward a hub axis extending through a medial hub point 114 and a lateral hub point 114 (and closer to a toe of the rapid-entry shoe 100) and a tongue rear portion 124 positioned rearward the hub axis (and closer to a heel of the rapid-entry shoe 100).

In example embodiments, a tongue forward portion 122 of the rotating tongue 120 is movable relative to a throat or a vamp of the upper 102 of the rapid-entry shoe 100. In this regard, in example embodiments, the rotating tongue 120 is not coupled at a tongue forward portion 122 to a throat or a vamp of the upper 102 of the rapid-entry shoe 100. Alternatively, in example embodiments, the rotating tongue 120 is solely coupled with a gusseted, baffled or elastic material at a tongue forward portion 122 to a throat or a vamp of the upper 102 of the rapid-entry shoe 100 (e.g., so as to permit relative movement of the same while still limiting entry of weather or debris into the interior volume of the rapid-entry shoe 100 defined by the upper 102).

In example embodiments, a rotating tongue 120 comprises a rigid or semi-rigid material or stiffener, e.g., a polymer material, carbon fiber material or the like. In example embodiments, the rigid or semi-rigid nature of the rotating tongue 120 imparts to it a predefined shape conforming for comfort and fit to an instep of a foot to be received in a rapid-entry shoe 100 according to the present disclosure. The predefined shape may also serve to direct an instep of a foot into an opening of the rapid-entry shoe 100 when the rotating tongue 120 is in the open configuration.

In example embodiments of the present disclosure, the rotating tongue 120 has an open configuration (e.g., for ease of donning or doffing by a foot) and a closed configuration (e.g., for retention of a foot).

Figure 1B:
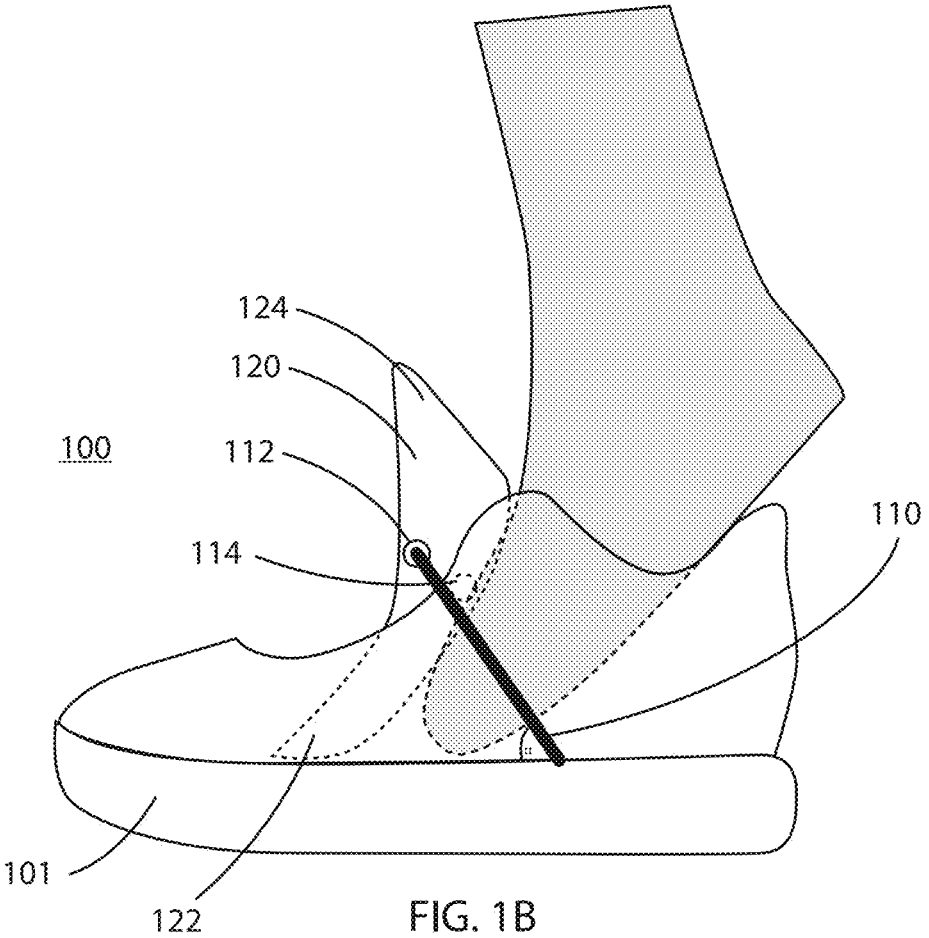
FIGS. 1B and 1C progressively illustrate entry of a foot into a rapid-entry shoe in accordance with the present disclosure.

With reference to FIG. 1B, in example embodiments of the present disclosure, in the open configuration, the tongue forward portion 122 is rotated downward toward the sole portion 101 about the hub axis to temporarily at least partially traverse, enter into or bisect the volume, and the tongue rear portion 124 is rotated upward away from the sole portion 101 about the hub axis to expand an opening to the volume to facilitate easy entry of the foot. In this regard, in the open configuration, tongue forward portion 122 can extend all (i.e., and be in contact with) or in some embodiments only partially to a sole portion 101 of the rapid-entry shoe 100.

Figure 1C:
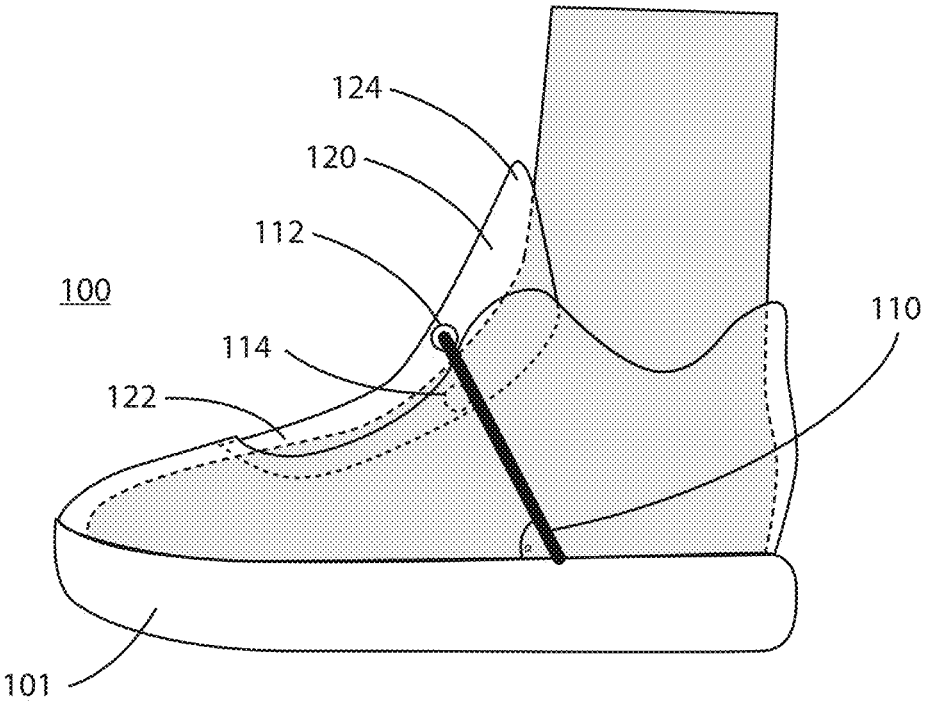

With reference to FIG. 1C, in example embodiments of the present disclosure, in the closed configuration, the tongue forward portion 122 is rotated upward away from the sole portion 101 about the hub axis by the foot entering the opening to the volume to no longer temporarily at least partially traverse, enter into or bisect the volume, and the tongue rear portion 124 is rotated downward toward the sole portion 101 about the hub axis to narrow the opening to the volume to facilitate securement of the foot.

In example embodiments of the present disclosure, the rotating tongue 120 is stable in the open configuration and in the closed configuration (i.e., bistable).

In example embodiments of the present disclosure, a rapid-entry shoe 100 further comprises an elongated element 110.

The elongated element 110 can have a first end coupled to the rotating tongue 120 at a coupling point 112 and a second end coupled to the sole portion 101 or the upper, wherein the first end is not also coupled to the sole portion 101 or the upper. The coupling point 112 can be located on the rotating tongue 120, for example, an upper surface of the rotating tongue 120. In such embodiments, a rapid-entry shoe 100 can comprise a first elongated element 110 on a lateral side of a rapid-entry-shoe 100 and a second elongated element 110 on a medial side.

Alternatively, the elongated element 110 can extend continuously between a lateral side (e.g., at the sole portion 101 or the upper) and a medial side of a rapid-entry-shoe 100 (e.g., at the sole portion 101 or the upper). In such embodiments, the elongated element 110 can extend through a coupling point 112 on the rotating tongue 120.

The elongated element 110 can be positioned external or internal to the upper, or extend between layers of the upper, as discussed further below.

In some embodiments, for example when an elongated element 110 extends continuously between medial and lateral sides of a rapid-entry shoe 100, the elongated element 110 rotates relative to the coupling point 112 as the rotating tongue 120 transitions between the open configuration and the closed configuration. For example, a rigid aglet coupled about the elongated element 110 can rotate through a channel or eyelet coupled to the rotating tongue 120. In other embodiments, the elongated element 110 is fixed relative to the coupling point 112 but the elongated element 110 exhibits twisting or torsional rotation along its length as the rotating tongue 120 transitions between the open configuration and the closed configuration.

In example embodiments of the present disclosure, as discussed below, the elongated element 110 does not intersect or is otherwise not in line with the hub axis in either the open configuration or the closed configuration. Over centered rotating or pivoting in this regard can contribute to the rotating tongue 120 being stable in the open configuration and in the closed configuration.

With continued reference to FIGS. 1A-1C, in example embodiments of the present disclosure, the elongated element 110 is longer in the open configuration than in the closed configuration (or about the same length in the open configuration and the closed configuration), and the hub axis is forward relative to the coupling point 112 in the closed configuration and rearward relative to the coupling point 112 in the open configuration. In such embodiments, hub points 114 (and a hub axis extending through hub points 114) can be above a quarter topline of the rapid-entry shoe in both the open configuration and the closed configuration. Additionally, in such embodiments, an angle $\alpha$, as measured between the elongated element 110 and the sole portion 101, may be smaller in the open configuration than in the closed configuration.

Figure 2A:
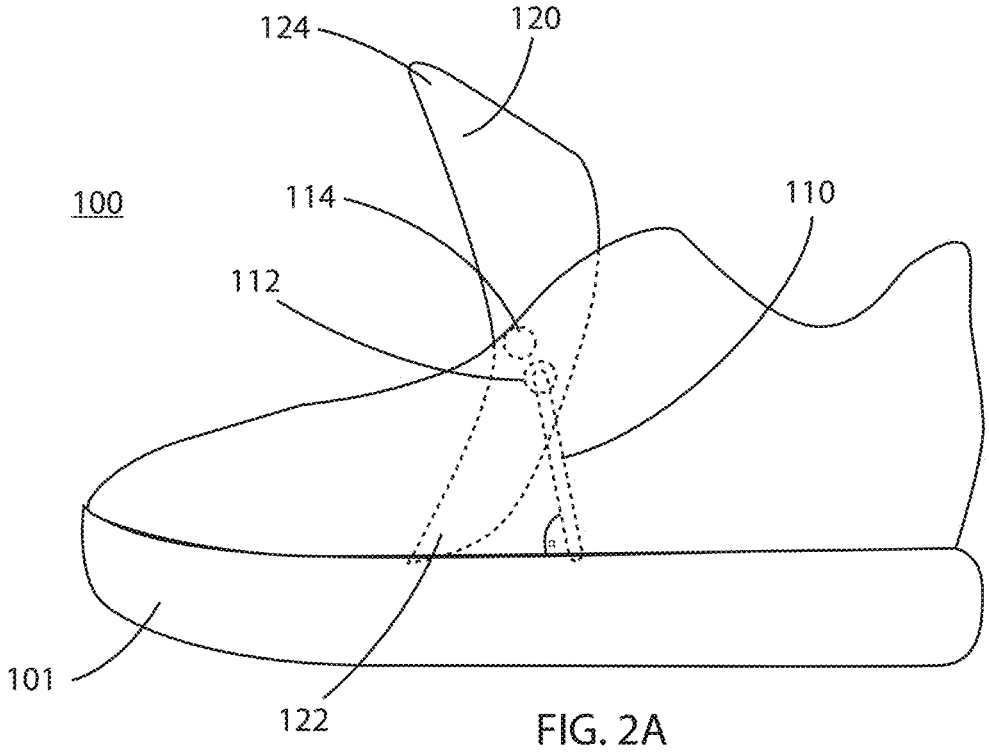
FIGS. 2A and 2B illustrate views of another rapid-entry shoe in accordance with the present disclosure, in open and closed configurations, respectively.
Figure 2B:
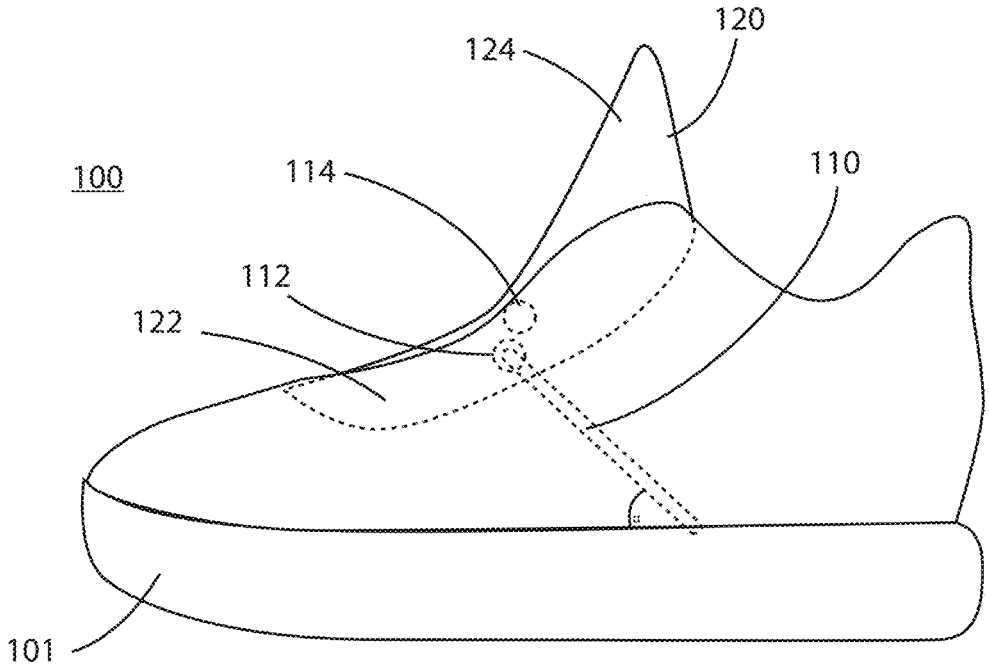

Turning to FIGS. 2A and 2B, in example embodiments of the present disclosure, the elongated element 110 is shorter in the open configuration than in the closed configuration, and the hub axis is rearward relative to the coupling point 112 in the closed configuration and forward relative to the coupling point 112 in the open configuration. In such embodiments, hub points 114 (and a hub axis extending through hub points 114) can be below a quarter topline of the rapid-entry shoe in both the open configuration and the closed configuration. Additionally, in such embodiments, an angle $\alpha$, as measured between the elongated element 110 and the sole portion 101, may be larger in the open configuration than in the closed configuration.

With continued reference to FIGS. 2A and 2B, in example embodiments of the present disclosure, all or a portion of the elongated element 110 is internal relative to the upper or extends through the upper. Of course, and with momentary reference back to FIGS. 1A-1C, in example embodiments of the present disclosure, all or a portion of the elongated element 110 is external relative to the upper.

In example embodiments, an elongated element 110 comprises an elastic material capable of stretching or otherwise resiliently deforming along its length, while in other embodiments an elongated element 110 comprises a material that is not configured to stretch or otherwise resiliently deform along its length.

Figure 3A:
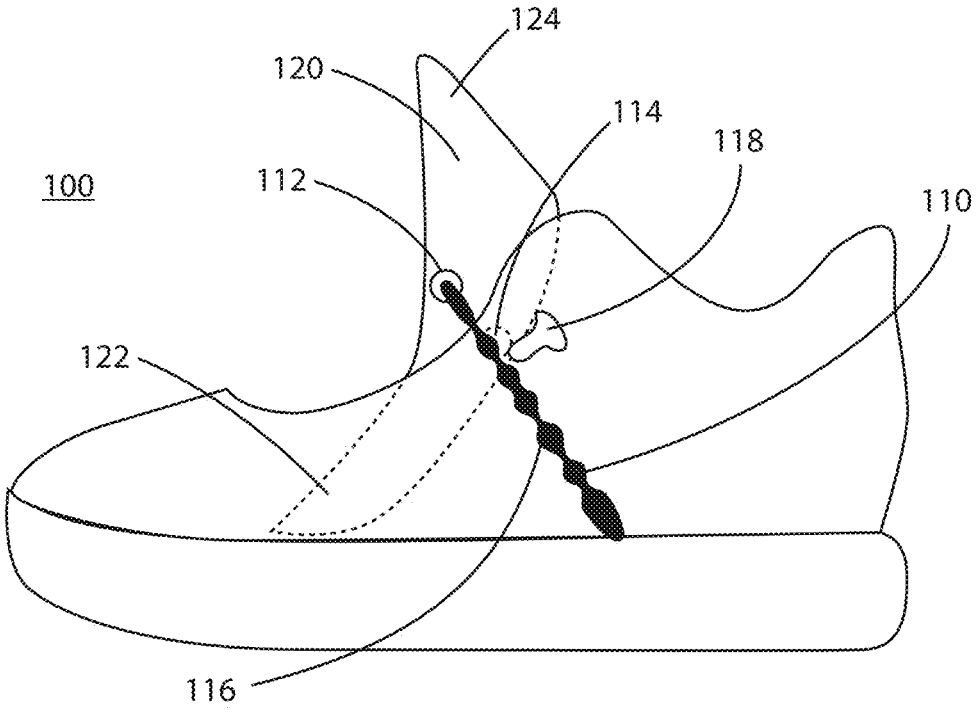
FIGS. 3A and 3B illustrate views of still another rapid-entry shoe in accordance with the present disclosure, in open and closed configurations, respectively.
Figure 3B:
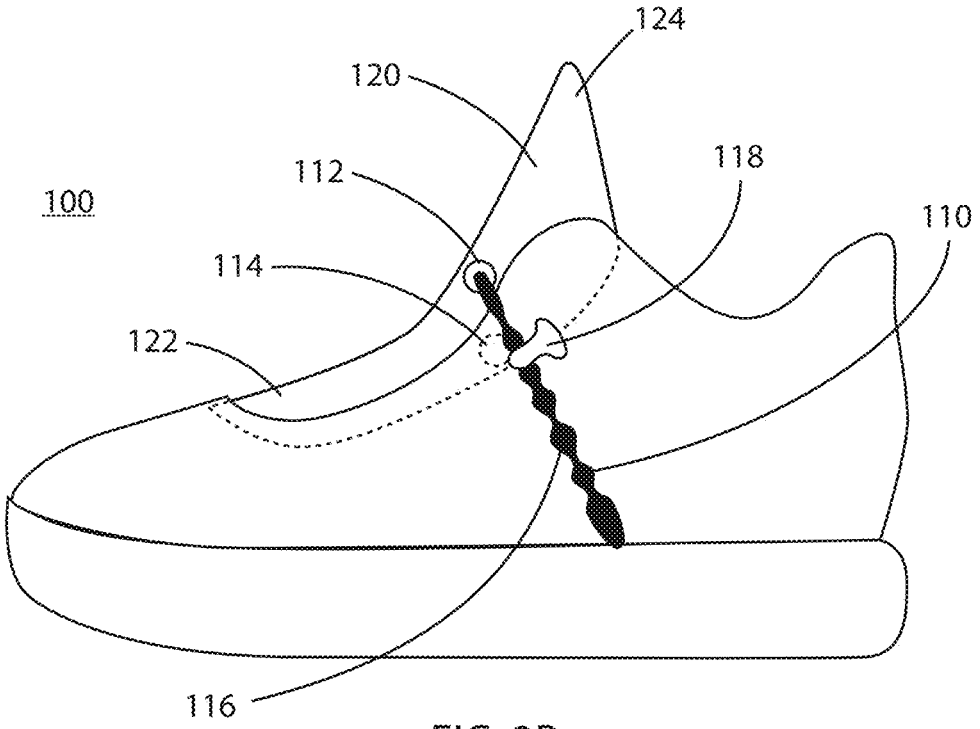

Turning now to FIGS. 3A and 3B, in example embodiments of the present disclosure, the elongated element 110 comprises a plurality of positive features 116 (e.g., ribs or bulges) to selectively engage with one or more of a plurality of corresponding negative features 118 (e.g., cleat, peg or hook) coupled to the upper to selectively lock the rotating tongue 120 in the open configuration and/or the closed configuration or otherwise increase or decrease a force necessary to transition the rotating tongue 120 between the open configuration and the closed configuration.

Without limiting the foregoing, in example embodiments, when the rotating tongue 120 is in the closed configuration, a negative feature 118 comprising a cleat can receive the elongated element 110 between adjacent positive features 116 comprising ribs 116, the adjacent positive features 116 preventing shearing motion of the elongated element 110 relative to the negative feature 118 (and thus preventing inadvertent transition of the rotating tongue 120 from the closed configuration to the open configuration). In such embodiments, when the rotating tongue 120 is in the open configuration, the elongated element 110 is not received by the negative feature 118. For example, in the open configuration, the elongated element 110 can be rotated forward beyond the negative feature 118.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

I claim:

1. A rapid-entry shoe comprising:

a sole portion;

an upper coupled to the sole portion, an inner surface of the upper defining a volume for receiving a foot of a user; and a rotating tongue, the rotating tongue coupled to the upper at a medial hub point and a lateral hub point aligned along a hub axis extending through the upper, and the rotating tongue comprising a tongue forward portion positioned forward the hub axis and a tongue rear portion positioned rearward the hub axis;

wherein the rotating tongue has an open configuration and a closed configuration;

wherein, in the open configuration, the tongue forward portion is rotated downward toward the sole portion about the hub axis to at least partially bisect the volume, and the tongue rear portion is rotated upward away from the sole portion about the hub axis to expand an opening to the volume to facilitate easy entry of the foot; and wherein, in the closed configuration, the tongue forward portion is rotated upward away from the sole portion about the hub axis by the foot entering the opening to the volume to no longer at least partially bisect the volume, and the tongue rear portion is rotated downward toward the sole portion about the hub axis to narrow the opening to the volume to facilitate securement of the foot.

2. The rapid-entry shoe of claim 1, wherein the rotating tongue is stable in the open configuration and in the closed configuration.

3. The rapid-entry shoe of claim 2, wherein shoe further comprises an elongated element having a first end coupled to the rotating tongue at a coupling point and a second end coupled to the sole portion or the upper, wherein the first end is not coupled to the upper.

4. The rapid-entry shoe of claim 3, wherein the elongated element does not intersect with the hub axis in either the open configuration or the closed configuration.

5. The rapid-entry shoe of claim 4, wherein the elongated element is longer in the open configuration than in the closed configuration, and wherein the hub axis is forward relative to the coupling point in the closed configuration and rearward relative to the coupling point in the open configuration.

6. The rapid-entry shoe of claim 4, wherein the elongated element is shorter in the open configuration than in the closed configuration, and wherein the hub axis is rearward relative to the coupling point in the closed configuration and forward relative to the coupling point in the open configuration.

7. The rapid-entry shoe of claim 4, wherein the elongated element comprises a plurality of positive features to selectively engage with one or more of a plurality of corresponding negative features coupled to the upper to selectively lock the rotating tongue in the open configuration or the closed configuration.

* * * * *